US010125950B2

(12) United States Patent
Liao et al.

(10) Patent No.: US 10,125,950 B2
(45) Date of Patent: Nov. 13, 2018

(54) OPTICAL MODULE

(71) Applicant: PlayNitride Inc., Tainan (TW)

(72) Inventors: Kuan-Yung Liao, Tainan (TW); Yun-Li Li, Tainan (TW); Gwo-Jiun Sheu, Tainan (TW); Sheng-Yuan Sun, Tainan (TW); Po-Jen Su, Tainan (TW); Jun-Yu Lin, Tainan (TW)

(73) Assignee: PlayNitride Inc., Tainan (TW)

( * ) Notice: Subject to any disclaimer, the term of this patent is extended or adjusted under 35 U.S.C. 154(b) by 66 days.

(21) Appl. No.: 14/967,396

(22) Filed: Dec. 14, 2015

(65) Prior Publication Data

US 2016/0186938 A1 Jun. 30, 2016

(30) Foreign Application Priority Data

Dec. 31, 2014 (TW) ..... 103146536 A

(51) Int. Cl.

| | |
|---|---|
| ***F21V 7/04*** | (2006.01) |
| ***F21V 9/30*** | (2018.01) |
| ***F21K 9/64*** | (2016.01) |
| *F21Y 115/30* | (2016.01) |
| *F21Y 113/20* | (2016.01) |
| *F21Y 115/10* | (2016.01) |

(52) U.S. Cl.
CPC ..... *F21V 9/30* (2018.02); *F21K 9/64* (2016.08); *F21V 7/04* (2013.01); *F21Y 2113/20* (2016.08);
(Continued)

(58) Field of Classification Search
CPC ..... F21S 48/1195; F21S 41/18
(Continued)

(56) References Cited

U.S. PATENT DOCUMENTS 8,258,527 B2 * 9/2012 Sato ..... F21V 7/0016 257/98
8,622,597 B2 * 1/2014 Tseng ..... F21S 48/1159 362/515
(Continued)

FOREIGN PATENT DOCUMENTS

CN 201885435 6/2011
CN 102866491 1/2013
(Continued)

OTHER PUBLICATIONS

S. S. Kushvaha et al, Highly c-axis oriented growth of GaN film on sapphire (0001) by laser molecular beam epitaxy using HVPE grown GaN bulk target, American Institute of Physics, AIP Advances 3, 092109 (2013), Sep. 10, 2013.*
(Continued)

*Primary Examiner* — Evan Dzierzynski
*Assistant Examiner* — Keith G Delahoussaye
(74) *Attorney, Agent, or Firm* — JCIPRNET

(57) ABSTRACT

An optical module including a reflecting component, a plurality of first light sources and a wavelength conversion body is provided. The reflecting component has a main axis and a focal point located on the main axis. The first light sources are located at one side of the reflecting component and each of the first light sources emits a first light parallel to the main axis towards the reflecting component. The wavelength conversion body is disposed on the focal point, wherein the first lights are reflected to the focal point via the reflecting component and a part of the first lights are converted to a second light via the wavelength conversion body. The second light and another part of the first lights are projected to the reflecting component and form a light beam parallel to the main axis via reflection by the reflecting component.

7 Claims, 3 Drawing Sheets

(52) U.S. Cl.
CPC ..... *F21Y 2115/10* (2016.08); *F21Y 2115/30* (2016.08)

(58) Field of Classification Search
USPC ..... 362/510, 517, 518, 516
See application file for complete search history.

(56) References Cited

U.S. PATENT DOCUMENTS

2013/0003400 A1* 1/2013 Kijima ..... F21S 48/1159 362/517
2014/0240677 A1* 8/2014 Hu ..... G02B 27/14 353/30

FOREIGN PATENT DOCUMENTS

| | | |
|---|---|---|
| CN | 103256567 | 8/2013 |
| TW | 201335650 | 9/2013 |
| TW | M486007 | 9/2014 |

OTHER PUBLICATIONS

"Office Action of Taiwan Counterpart Application" , dated Apr. 26, 2016, p. 1-p. 7.

* cited by examiner

OPTICAL MODULE

CROSS-REFERENCE TO RELATED APPLICATION

This application claims the priority benefit of Taiwan application serial no. 103146536, filed on Dec. 31, 2014. The entirety of the above-mentioned patent application is hereby incorporated by reference herein and made a part of this specification.

BACKGROUND OF THE INVENTION

Field of the Invention

This invention relates to an optical module, and particularly related to an optical module which has improved light utilization.

Description of Related Art

With the raise in the awareness for global environment, low power consumption electronic products have become the trend today. Take lighting industry as an example, due to the low power consumption, efficiency, fast reaction time, long lifetime, and being free of mercury, light-emitting diodes (LEDs) and laser diodes (LDs) are gradually graining market share.

Take LDs as an example, the laser beam emitted from a plurality of LDs require condensation by, for instance, use of lens in order to integrate the LD light sources and form a straight parallel beam. More specifically, currently methods usual involve disposing a plurality of LDs on a focal point of a convex lens in order to convert the light emitted from the focal point of the convex lens to the parallel beam after being refracted via the convex lens, but due to limitations such as the size of convex lenses and relative configurations of convex lens and LDs, the light utilization of LDs cannot be effectively increased.

SUMMARY OF THE INVENTION

Accordingly, the invention provides an optical module having better light utilization.

The invention provides an optical module including a reflecting component, a plurality of first light sources, and a wavelength conversion body. The reflecting component has a main axis and a focal point located on the main axis. The first light sources are located at one side of the reflecting component, and each of the first light sources emits a first light parallel to the main axis towards the reflecting component. The wavelength conversion body is disposed on the focal point, wherein the first lights are reflected to the focal point via the reflecting component and a part of the first lights are converted to a second light via the wavelength conversion body. The second light and another part of the first lights are projected to the reflecting component in order to form a light beam parallel to the main axis via reflection by the reflecting component.

According to an embodiment, the focal point is located between the first light sources and the reflecting component.

According to an embodiment of the invention, the optical module further includes a second light source configured on the focal point, wherein the wavelength conversion body is disposed on the second light source.

According to an embodiment, the first light sources are LDs, and the second light source is an LED.

According to an embodiment of the invention, the reflecting component includes a spherical reflector, a parabolic reflector, or an ellipsoid reflector.

The invention provides another optical module including a first reflecting component, a second reflection component, a plurality of first light sources, and a wavelength conversion body. The first reflecting component has a main axis and a first focal point located on the main axis. The second reflecting component is configured opposite to the first reflecting component, wherein the second reflecting component has a second focal point, and the second focal point and the first focal point are located on a common point. The first light sources are located at one side of the second reflecting component, and each of the first light sources emits a first light parallel to the main axis towards the second reflecting component. The wavelength conversion body is disposed on the common point, wherein the first lights are reflected to the common point via the second reflecting component and a part of the first lights are converted into a second light via the wavelength conversion body. The second light and another part of the first lights are projected to the first reflecting component and form a light beam parallel to the main axis via reflection by the first reflecting component.

According to an embodiment, the common point is located between the first reflecting component and the second reflecting component.

According to an embodiment, the optical module further includes a second light source located on the common point, wherein the wavelength conversion body is disposed on the second light source.

Based on the above, the optical module of the invention reflects the first lights emitted from the plurality of first light sources to the wavelength conversion body disposed on the focal point of the reflecting component via the reflecting component, wherein the wavelength conversion body converts a part of the first lights to the second light, and reflects the second light back to the reflecting component. Since the second light and the unconverted part of the first lights are sufficiently mixed after being projected from the focal point of the reflecting component, the parallel light beam is formed via reflection by the reflecting component for subsequent optical utilization. As a result, the optical module of the invention, without requiring a lens, increases the light utilization by effectively focusing a plurality of light sources and work with the wavelength conversion body.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
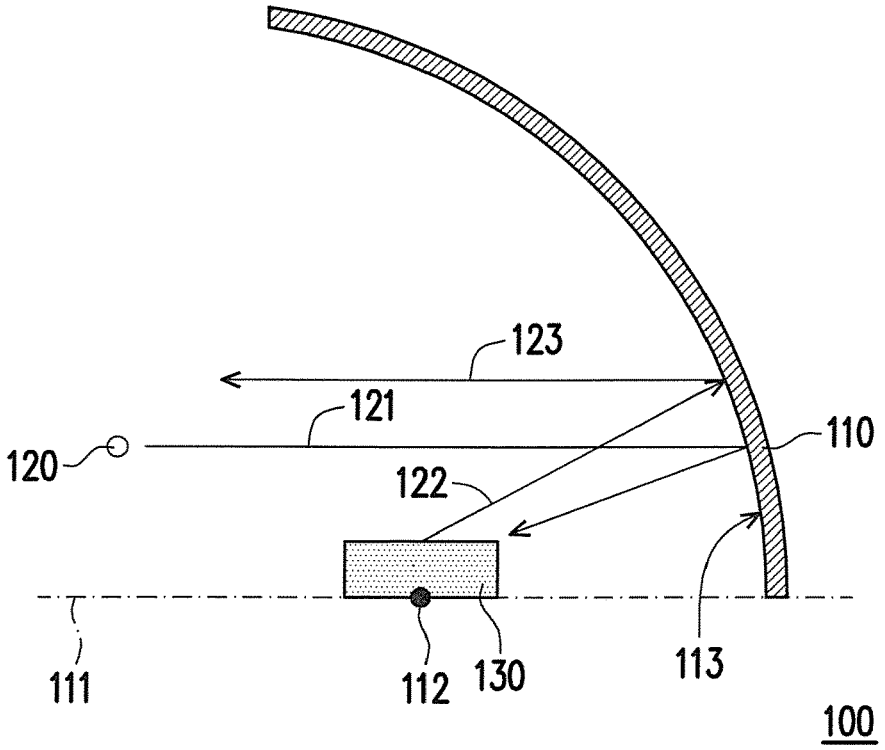
FIG. 1A is a side view schematic of the optical module according to the first embodiment.

Reference will now be made in detail to the present preferred embodiments of the invention, examples of which are illustrated in the accompanying drawings. Wherever possible, the same reference numbers are used in the drawings and the description to refer to the same or like parts.

Figure 1B:
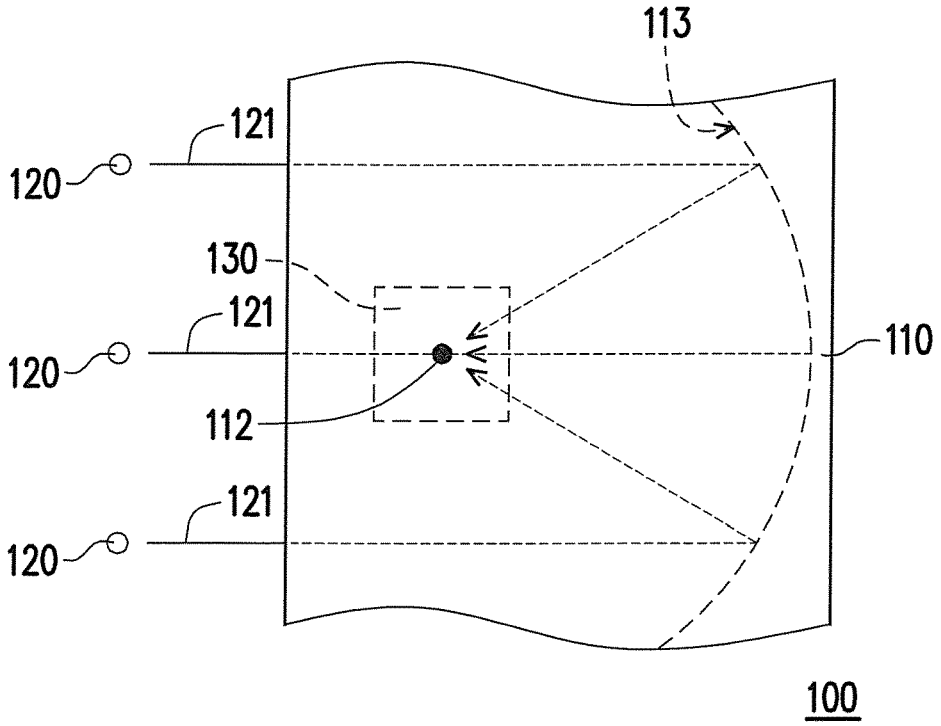
FIG. 1B is a top view schematic of the optical module in 1A.

FIG. 1A is a side view schematic of the optical module according to the first embodiment. FIG. 1B is a top view schematic of the optical module in 1A, wherein to make the description and display more clear, the second light 122 and the light beam 123 are omitted in FIG. 1B. Referring to FIGS. 1A and 1B, in the embodiment, the optical module 100 can be adopted in flashbulb, vehicle lamp, flashlights, and so on. The optical module 100 includes a reflecting component 110, a plurality of light sources 120, and a wavelength conversion body 130. The reflecting component 110 is a curved surface reflector, for instance, a spherical reflector, a parabolic reflector, or an ellipsoid reflector, with a parabolic reflector being the preferred choice, having a main axis 111 and a focal point 112 located on the main axis 111.

For instance, the first light sources 120 can be a plurality of LDs, a plurality of LEDs, or a combination of LDs and LEDs. The invention does not set a limitation. The arrangement of the first light sources 120 are a plurality of LDs, a plurality of LEDs, or a combination of LDs and LEDs being arranged linearly, in matrix, or randomly. The first light sources 120 may also be selected from combinations of light sources of different wavelengths. As shown by FIG. 1B, the embodiment illustrates with a plurality of the first light sources 120 of the same wavelength and arranged linearly, but the invention does not set a limitation. Preferably, the light sources 120 are a plurality of LDs. Due to better collimation of LDs, the lights generated from LDs can be concentrated and reflected via the reflection component 110, and as a result are beneficial to subsequent designs of optical application. But the invention does not set a limitation on the light source.

The light sources 120 are located at one side of the reflecting component 110, wherein the focal point 112 is located between the first light sources 120 and the reflecting component 110, and an end portion of the reflecting component 110 substantially extends above the focal point 112 in order to collect the light emitted from the light sources 120. Each of the first light sources 120 are adapted to emit first lights 121 toward a curved surface 113 of the reflecting component 110. Specifically, the first lights 121 are reflected to the focal point 112 after being reflected to the curved surface 113 of the reflective component 110. More specifically, the first lights 121 are substantially projected to the curved surface 113 of the reflecting component 110 along a direction parallel to the main axis 111. As a result, based on reflection principle of curved surface reflector, all of the first lights 121 emitted from the first light sources 120 are reflected by the reflecting component 110 to focus on the focal point 112. In the embodiment, the first light sources 120 are, for instance, a plurality of LDs, with the reason for adopting LDs being better collimation. In other words, the first light sources 120 are closer to the form of spot light sources, such that the first lights 121 emitted from the first light sources 120 to more effectively focus on the focal point 112 via the reflecting component 110 without loss of light caused by loss of focus.

The wavelength conversion body 130 is disposed on the focal point 112, such that the wavelength conversion body 130 is also located between the first light sources 120 and the reflecting component 110, and an end portion of the reflecting component 110 also substantially extends above the wavelength conversion body 130, so as to collect the lights converted by the wavelength conversion body 130. In other words, the orthogonal projection of the reflecting component 110 on the main axis 111 covers the wavelength conversion body 130. Herein, the wavelength conversion body 130 can be a fluorescent body having a mono-crystalline structure for better efficiency of heat dissipation, but the invention does not set a limit. In another embodiment, the wavelength conversion body 130 can also be formed by solidifying a transparent gel mixed with a non-mono-crystalline fluorescent material, a phosphorescent material, or dyes. As far as the transparent gel mixed with the phosphor powder material is concerned, the transparent gel may be epoxy resin, acrylic resin, silicone resin or silica gel. The transparent gel may be mixed with single colored or multicolored phosphor powder materials. For example, a yellow phosphor powder material or a green phosphor powder material includes components such as Sr, Ga, S, P, Si, O, Gd, Ce, Lu, Ba, Ca, N, Si, Eu, Y, Cd, Zn, Se, and Al. For instance, the phosphor powder may be garnet phosphor, silicate phosphor, nitrogen compound phosphor, or oxide-nitride compound phosphor. The phosphor powder may also be yttrium aluminum garnet (YAG) phosphor, terbium aluminum garnet (TAG) phosphor, Eu-activated alkaline earth silicate phosphor, or SiAlON phosphor. In another embodiment, the wavelength conversion body 130 may also be formed into a block by sintering laminated powder containing phosphor powder.

After the first lights 121 are reflected from the reflecting component 110 to the wavelength conversion body 130 on the focal point 112, the wavelength conversion body 130 converts the wavelength of a part of the first lights 121 to second light 122 with a different wavelength. The second light 122 can be mixed with another part of the first lights 121 which are not converted by the wavelength conversion body 130 and emit the needed color of light, and then project to the reflecting component 110. For instance, in the case that the first lights 121 are blue lights and the wavelength conversion body 130 converts blue lights to yellow lights, white lights can be obtained by mixing the second light 122 (i.e., the yellow lights) converted from the wavelength conversion body 130 and another part of the first lights 121 (i.e., the blue lights) which are not converted by the wavelength conversion body 130. Note that the wavelength of first lights 121 and the wavelength of the second light 122 obtained from converting the first lights 121 projected to the wavelength conversion body 130 are used as examples, and the invention does not set a limit. And through, for instance, a reflecting body (not in the drawings) disposed on the side of the wavelength conversion body 130 other than the side reflecting the first lights 121, or through mixing reflecting particles (not in the drawings) to the wavelength conversion body 130, to cause the first lights 121 and the second light 122 to be more efficiently projected to the reflecting components 110 after mixing. The invention does not set a limitation. In particular, the wavelength conversion body 130 is disposed along the direction of a main axis 111 in a, for instance, flat manner. However, the wavelength conversion body 130 may also be disposed according to the curvature of the reflecting component 110 or actual application needs and take the form of, for instance, a shape having curved surface or other different shapes having tilted angle. When disposed in such manner, the cost can be lowered and conversion efficiency can be increased due to an increased surface of the wavelength conversion body 130.

Since the second light 122 and the part of the first lights 121 not converted by the wavelength conversion body 130 are emitted from the focal point 112 of the reflecting component 110, after being projected to the reflecting component 110, light beam 123 (i.e., the parallel light beam) parallel to the main axis 111 is formed via reflection of the curved surface 113 of the reflecting component 110 for subsequent optical applications. In other words, the optical module 100 of the embodiment effectively focus or converge multiple light sources without requiring lens or other optical elements, such that the light utilization is increased.

Other embodiments are described below to further illustrate. It should be noted that the embodiments below utilize component labels and partial content from the aforementioned embodiment, wherein identical or similar elements are labeled with identical labels, and therefore description of similar technical content will be omitted. Regarding the details of the omitted parts reference to the previous embodiment can be made, and will not be repeated in the embodiments below.

Figure 2:
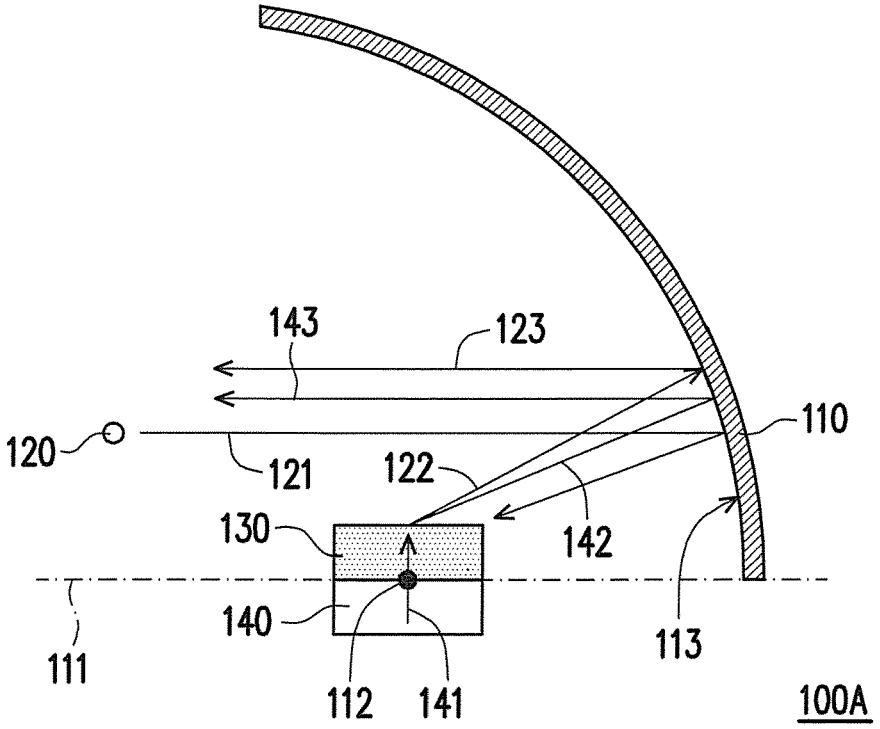
FIG. 2 is a side view schematic of the optical module according to the second embodiment.

FIG. 2 is a side view schematic of the optical module according to the second embodiment. Referring to FIG. 2, optical module 100A of FIG. 2 is similar to the optical module 100 of FIG. 1, with the main difference being: the optical module 100A further includes a second light source 140 located on the focal point 112, wherein the wavelength conversion body 130 is disposed on the second light source 140. In the embodiment, first lights 141 emitted from the second light source 140 are directly converted to second light 142 via the wavelength conversion body 130. Since the second light source 140 is located on the focal point 112 of the reflecting component 110, the second light 142 and the unconverted part of the first lights 141 are projected to the reflecting component 110, and light beam 143 (i.e., parallel light beam) parallel to the main axis 111 is formed via reflection of the curved surface 113 of the reflecting component 110. Adding the light beam 123 formed by the first light sources 120, lights emitted from multiple light sources can be effectively concentrated without requiring additional optical component such as a lens. In other words, the optical module 100A having the first light sources 120 and the second light source 140 of the embodiment not only can increase the light utilization, but also provides higher intensity of light. Herein, the first light sources 120 and the second light source 140 may also be a plurality of LDs, LEDs, or a combination thereof. According to the embodiment, the first light sources 120 are a plurality of LDs, and the second light source 140 is an LED. Preferably, the second light source 140 and the wavelength conversion body 130 are an integrated structure in order to save fabricating time and reduce the size of the optical module, but the invention does not set a limit. The first light sources 120 and the second light source 140 may have different light colors. For instance, the first light sources 120 are blue light and the second light source 140 is red light, such that the color rendering index is better. Additionally, the second light source 140 may be III-V molecular epitaxy structure (not in the drawings) grown on a substrate. When the first light sources 120 and the first lights 141 are projected to the second light source 140 which is also located on the focal point, since the first light sources 120 is a high efficiency LD, through photo-luminescence (PL) principle cause the second light source 140 to emit the first lights 141, then convert part of the first lights 141 to the second light 142 via wavelength conversion body 130, such that the optical module 100A yields better color rendering index. With the second light source 140 made of III-V molecular epitaxy structure, reliability of the optical module 100A is also increased. The material for the second light source 140 can be selected based on subsequent optical design application and adapted to emit the appropriate wavelength. The invention does not set a limit.

Figure 3:
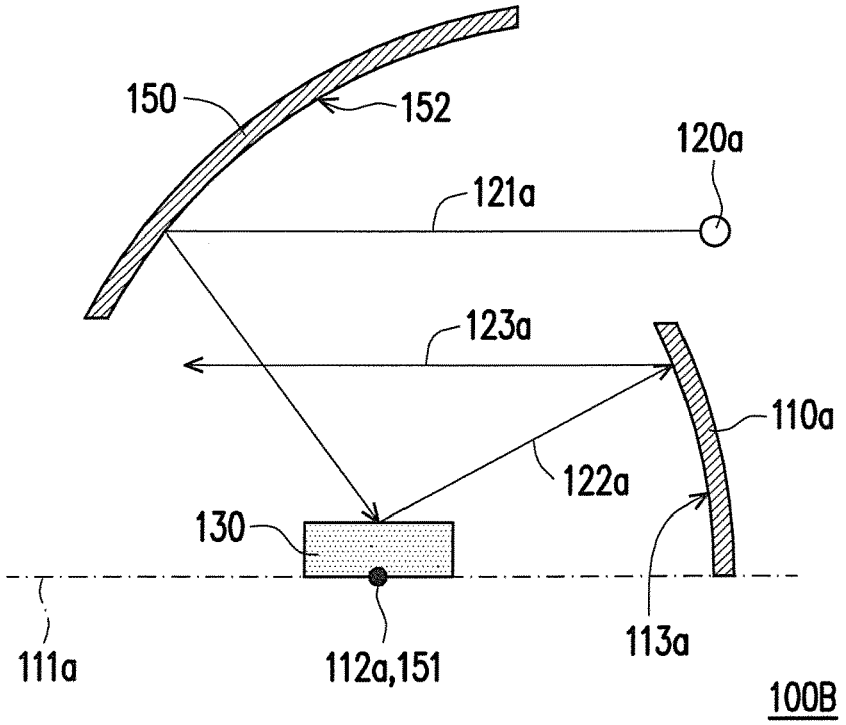
FIG. 3 is a side view schematic of the optical module according to the third embodiment.

FIG. 3 is a side view schematic of the optical module according to the third embodiment. Referring to FIG. 3, the optical module 100B of FIG. 3 is similar to the optical module 100 of FIG. 1, with the main difference being: the optical module 100B further includes a reflecting component 150 configured opposite to reflecting component 110*a*, wherein a focal point 151 of the reflecting component 150 and a focal point 112*a* of the reflecting component 110*a* are located on common point, and an end portion of the reflecting component 150 substantially extends above the common point in order to collect lights emitted from first light sources 120*a*.

On the other hand, the plurality of light sources 120*a* are disposed at one side of the reflecting component 150, so as to cause first lights 121*a* emitted from the first light sources 120*a* to be projected to a curved surface 152 of the reflecting component 150, wherein the first lights 121*a* of the curved surface 152 projected to the reflecting component 150 along a direction parallel to a main axis 111*a* is reflected to the common point via the reflecting component 150, and a part of the first lights 121 a are converted to second light 122*a* via the wavelength conversion body 130. As a result, the second light 122*a* and the unconverted part of the first lights 121*a* are projected to the reflecting component 110*a* after being mixed, to form the light beam 123*a* (i.e., parallel light beam) which parallel the main axis 111*a* via reflection by a curved surface 113*a* of the reflecting component 110*a* and project the light beam 123*a* to a distance. In other words, the optical module 100B of the embodiment also increases the light utilization. It should be noted that a reflector (not shown) can be disposed on the wavelength conversion body 130, such as around an outer surface of the wavelength conversion body 130 which is away from the reflecting component 110*a*, to let the second light 122*a* and the unconverted part of the first lights 121*a* could be projected to the reflecting component 110*a*. It depends on the design of actual needs, and the invention does not set a limit.

In the embodiment, since the common point is located between the reflecting component 110*a* and the reflecting component 150, and the reflecting component 110*a* and the reflecting component 150 have substantially the same focal length, the reflecting component 110*a* and the reflecting component 150 are, for instance, formed by two curved reflectors having the same curvature and disposed opposite to each other. Preferably, the two curved reflectors are parabolic reflectors. In particular, in another embodiment, the reflecting component 110*a* and the reflecting component 150 may also have different focal lengths and curvatures, so as to adjust the distance between the common point and the reflecting component 110*a* and the reflecting component 150, thereby reducing the volume of the optical module 100B. In other words, if the design is based on the focal point of the reflector 110*a* and the focal point of the reflector 150 are common point, then the reflectors 110*a* and 150 can have the same focal lengths and curvatures or different focal lengths and curvatures, depending on the actual needs. The invention does not set a limit. In particular, in order to reduce cutoff of reflection, the orthogonal projection of the reflecting component 110*a* on the main axis 111*a* and the orthogonal projection of the reflecting component 150 on the axis 111*a* do not overlap.

Figure 4:
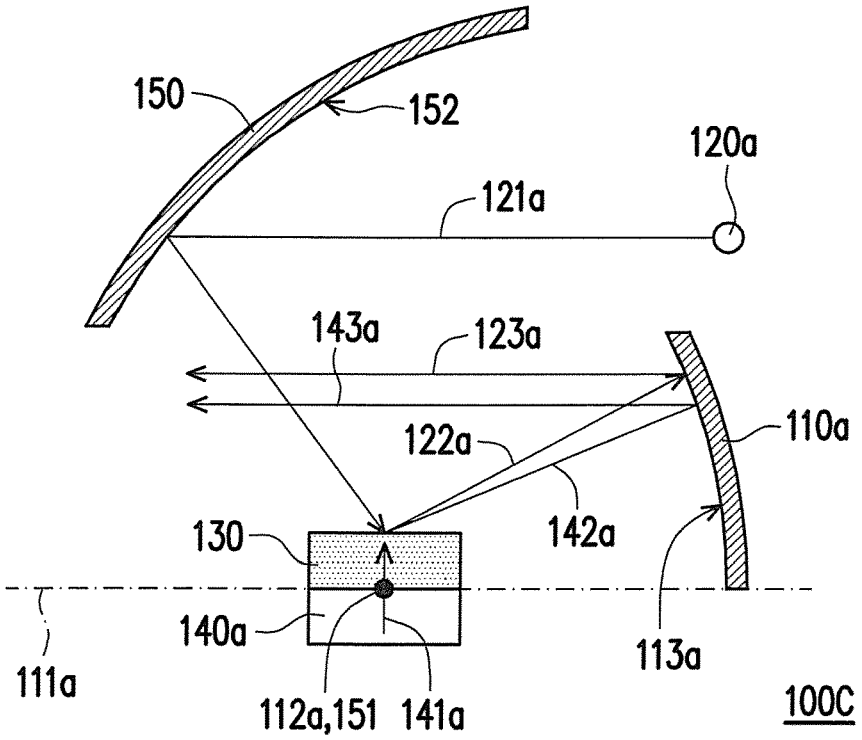
FIG. 4 is a side view schematic of the optical module according to the fourth embodiment.

FIG. 4 is a side view schematic of the optical module according to the fourth embodiment. Referring to FIG. 4, an optical module 100C is similar to the optical module 100B of FIG. 3, with the main differences being: the optical module 100C further includes a second light source 140*a* located on the first focal point 112*a* or the second focal point 151 (i.e., common point), wherein the wavelength conversion body 130 is disposed on the second light source 140*a*. In the embodiment, first lights 141*a* emitted from the second light source 140*a* are directly converted to the second light 142*a* via the wavelength conversion body 130, and since the second light 142*a* and the unconverted first lights 141*a* are emitted from the common point of the reflecting component 110, after being projected to the reflecting component 110*a*, light beam 143*a* (i.e., the parallel light beam) parallel to the main axis 111 a is formed via reflection of the curved surface 113*a* of the reflecting component 110*a* for subsequent optical applications. Furthermore, aided by the first lights 121 a of the first light source 120*a* and the second light 122*a*, multiple light sources can be concentrated without requiring additional disposition of optical components (e.g., lens). In other words, the optical module 100C having the first light sources 120*a* and the second light source 140*a* of the embodiment not only can increase the light utilization, but also provides higher intensity of light.

Figure 5:
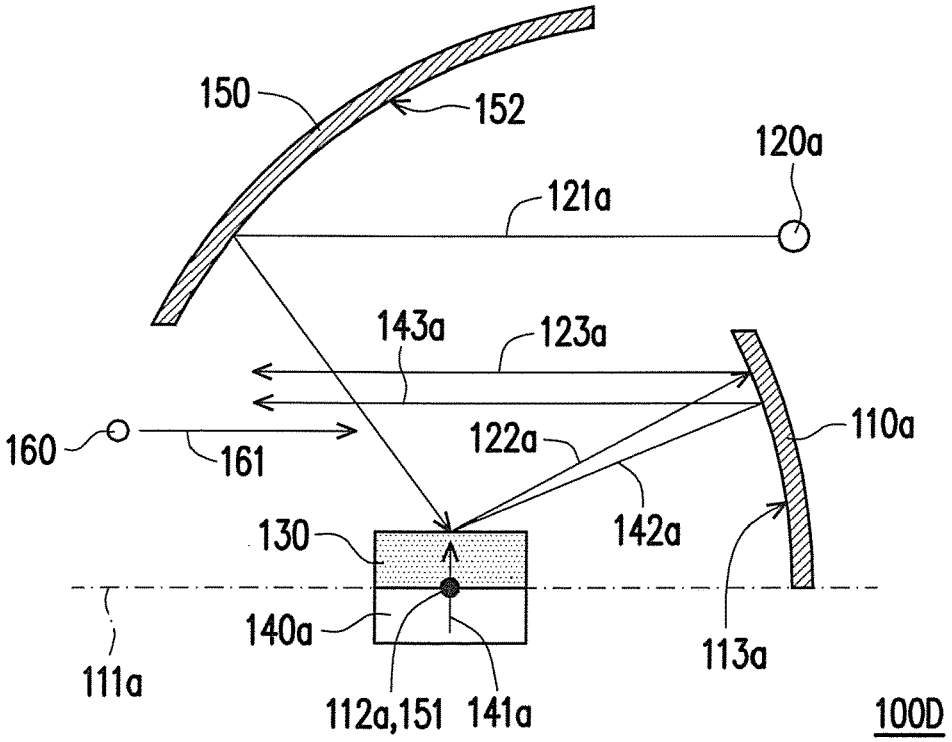
FIG. 5 is a side view schematic of the optical module according to the fifth embodiment.

FIG. 5 is a side view schematic of the optical module according to the fifth embodiment. Referring to FIG. 5, the optical module 100D of FIG. 5 is similar to the optical module 100C of FIG. 4, with the main difference being: the optical module 100D further includes a third light source 160 located at one side of the reflecting component 110*a*, wherein the first focal point 112*a* or the second focal point 151 (i.e., common point) is located between the third light source 160 and the reflecting component 110*a*. More particularly, since the configuration of the third light source 160 is similar to the configuration of the first light source 120 as shown in FIG. 1A, the transmission manner and reflection mechanism of a first light 161 emitted from the third light source 160 are also similar to the first lights 121 emitted from the first light sources 120, and will not be repeated below. In other words, the embodiment includes an optical module 100D having the first light sources 120*a*, the second light source 140*a*, and the third light source 160 can be used to concentrate multiple light sources for subsequent optical applications. This way, not only the light utilization is increased, but higher light intensity is provided. It should be further noted that in an embodiment not shown in the drawings, the optical module also adopts the configuration of the first light sources 120*a* and the third light source 160 as shown in FIG. 5, without having the second light source 140*a*. The invention does not set a limit thereon.

In view of the foregoing, in the optical module of the invention, the first lights emitted from the plurality of light sources are reflected to the wavelength conversion body disposed on the focal point of the reflecting component via the reflecting component, wherein the wavelength conversion body converts a part of the first lights to the second light, and reflects the second light to the reflecting component. Since the second light and the unconverted part of the first lights are sufficiently mixed after being emitted from the focal point of the reflecting component, parallel light beam is formed via reflection by the reflecting component for subsequent optical utilization. As a result, the optical module of the invention, without requiring a lens, increases the light utilization by effectively focusing a plurality of light sources and work with the wavelength conversion body.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An optical module, comprising:

a first reflecting component having a main axis and a first focal point located on the main axis;

a second reflecting component configured opposite to the first reflecting component, wherein the second reflecting component has a second focal point and the second focal point and the first focal point are located on a common point;

a plurality of first light sources located at one side of the second reflecting component, each of the first light sources emitting a first light parallel to the main axis towards the second reflecting component;

a wavelength conversion body disposed on the common point, wherein the first lights parallel to the main axis are reflected to the wavelength conversion body disposed on the common point via the second reflecting component and a part of the first lights are converted into a second light via the wavelength conversion body, the second light and another part of the first lights are projected to the first reflecting component and forming a first light beam parallel to the main axis via reflection by the first reflecting component; and a second light source located on the common point, wherein the wavelength conversion body is configured on the second light source, and the second light source comprises a laser diode or a light-emitting diode, wherein the second light source comprises a III-V molecular epitaxy structure, wherein the second light source emits a light through the wavelength conversion body and is projected to the first reflecting component and forming a second light beam parallel to the main axis via reflection by the first reflecting component, wherein the common point is located between the first reflecting component and the second reflecting component, and the first reflecting component and the second reflecting component have the same focal length.

2. The optical module as claimed in claim 1, wherein the first light sources comprise a plurality of laser diodes and the second light source is a light-emitting diode.

3. The optical module as claimed in claim 1, wherein the first and second reflecting components comprise a spherical reflector, a parabolic reflector, or an ellipsoid reflector.

4. The optical module as claimed in claim 1, wherein the first light source and the second light source have different light colors.

5. The optical module as claimed in claim 1, wherein the wavelength conversion body has a curved surface.

6. The optical module as claimed in claim 1, wherein the wavelength conversion body and the second light source are disposed conformally.

7. The optical module as claimed in claim 1, wherein a reflecting body is disposed on a side of the wavelength conversion body other than another side of the wavelength conversion body reflecting the first lights.

* * * * *